United States Patent [19]

Mussinellil

[11] Patent Number: 5,062,934

[45] Date of Patent: Nov. 5, 1991

[54] METHOD AND APPARATUS FOR CATHODIC PROTECTION

[75] Inventor: Gian L. Mussinellil, Como, Italy

[73] Assignee: Oronzio deNora S.A., Bioggio, Switzerland

[21] Appl. No.: 452,561

[22] Filed: Dec. 18, 1989

[51] Int. Cl.[5] ..... C23F 13/00

[52] U.S. Cl. ..... 204/147; 204/196; 204/284; 204/290 F

[58] Field of Search ..... 204/147, 196, 284, 290 F

[56] References Cited

U.S. PATENT DOCUMENTS

| | | | |
|---|---|---|---|
| 3,804,740 | 4/1974 | Welch | 204/290 F |
| 4,528,084 | 7/1985 | Beer et al. | 204/290 F |
| 4,708,888 | 11/1987 | Mitchell et al. | 204/284 |
| 4,855,024 | 8/1989 | Drachnik et al. | 204/284 |

*Primary Examiner*—T. Tung

*Attorney, Agent, or Firm*—Bierman & Muserlian

[57] ABSTRACT

A grid electrode for cathodic protection of steel rebar reinforced concrete structures comprising a plurality of valve metal strips having voids with an electrocatalytic surface and 2,000 to 7,000 nodes per square meter electrically conncected together to form a grid and a method of cathodically protecting steel rebar reinforced concrete structures comprising impressing a constant anodic current upon a grid made up by a plurality of valve metal strips with voids with an electrocatalytic surface and 2,000 to 7,000 nodes per square meter embedded in a steel reinforced concrete structure containing 0.5 to 5 square meters of steel surface for each square meter of concrete surface with the ratio of electrode surface to the steel surface density being selected to maintain a uniform cathodic protection current density throughout the concrete structure.

20 Claims, 1 Drawing Sheet

METHOD AND APPARATUS FOR CATHODIC PROTECTION

STATE OF THE ART

Cathodic protection of metal substrates is well known. The substrate is made the cathode in a circuit which includes a DC current source, an anode, and an electrolyte between the anode and the cathode. The exposed surface of the anode is made of a material which is resistant to corrosion, for example platinum on a valve metal substrate such as titanium or a dispersion in an organic polymer of carbon black or graphite. The anode can be a discrete anode, or it can be a distributed anode in the form of an elongated strip or a conductive paint. There are many types of substrate which need protection from corrosion, including reinforcing members in concrete, which are often referred to as "rebars". Most Portland Cement concrete is sufficiently porous to allow passage of oxygen and aqueous electrolyte through it. Consequently, salt solutions which remain in the concrete or which permeate the concrete from the outside, will cause corrosion of rebars in the concrete. This is especially true when the electrolyte contains chloride ions, as for example in structures which are contacted by the sea, and also in bridges, parking garages, etc. which are exposed to water containing salt used for deicing purposes or finally, when calcium chloride has been added to the mortar as hydration accelerator.

The corrosion products of the rebar occupy a much larger volume then the metal consumed by the corrosion. As a result, the corrosion process not only weakens the rebar, but also, and more importantly, causes cracks and spalls in the concrete. It is only within the last ten or fifteen years that it has been appreciated that corrosion of rebars in concrete poses problems of the most serious kind, in terms not only of cost but also of human safety. There are already many reinforced concrete structures which are unsafe or unuseable because of deterioration of the concrete as a result of corrosion of the rebar, and unless some practical solution to the problem can be found, the number of such structures will increase dramatically over the next decade. Consequently, much effort and expense have been devoted to the development of methods for cathodic protection of rebars in concrete. However, the known methods yield poor results and/or involve expensive and inconvenient installation procedures.

For details of known methods of cathodic protection, reference may be made for example to U.S. Pat. Nos. 4,319,854 (Marzocchi), 4,255,241 (Kroon), 4,267,029 (Massarsky), 3,868,313 (Gay), 3,798,142 (Evans), 3,391,072 (Pearson), 3,354,063 (Shutt) 3,022,242 (Anderson), 2,053,314 (Brown) and 1,842,541 (Cumberland), U.K. Patents No. 1,394,292 and 2,046,789, and Japanese Patents No. 35293/1973 and 48948/1978. The entire disclosures of each of the patents and applications listed above are incorporated herein by reference.

British patent application Ser. No. 2,175,609 describes an extended area electrode comprising a plurality of wires in the form of an open mesh provided with an anodically active coating which may be used for the cathodic protection of steel rebars in reinforced concrete structures.

U.S. Pat. No. 4,708,888 describes a cathodic protection system using anodes comprising a highly expanded valve metal mesh provided with a pattern of substantially diamond shaped voids having LWD and SWD dimensions for units of the pattern, the pattern of voids being defined by a continuum of thin valve metal strands interconnected at nodes and carrying on their surface an electrocatalytic coating. The mesh is made from highly expanded valve metal sheets, i.e. more than 90% or by weaving valve metal wire to form the same. However, the electrodes of this patent have only 500 to 2,000 nodes per square meter which means the anode is greatly expanded. The strands of the said U.S. patent and the British patent application Ser. No. 2,175,609 are subject to easy breakage resulting in areas of no current density where rebars are unprotected and areas of increased concentration of current density. Moreover, there is no means of varying the current density to accommodate different steel surface densities.

OBJECTS OF THE INVENTION

It is an object of the invention to provide a novel cathodic protection system for rebars in concentrate structures wherein the current discharge can be varied according to the density of the steel rebars to avoid underprotection and/or overprotection areas.

It is another object of the invention to provide an improved grid electrode with a variable anodic surface for uniform current distribution according to steel surface density and an improved cathodic protected concrete structure per se.

These and other objects and advantages of the invention will become obvious from the following detailed description.

THE INVENTION

The novel grid electrodes of the invention for the cathodic protection of steel rebar reinforced structure are comprised of a plurality of valve metal strips with voids therein with an electrocatalytic surface and 2,000 to 7,000 nodes per square meter electrically connected together to form the grid. The voids in the valve metal strips may be formed by punching holes in the valve metal strips but the more economical method is to use expanded valve metal strips with an expansion of up to 50%.

Examples of valve metals are titanium, tantalum, zirconium and niobium, with titanium being preferred because of its strength, corrosion resistance and its ready availability and cost. The valve metals may also be used in the form of metal alloys and intermetallic mixtures. Suitable alloys are described in commonly assigned U.S. patent application Ser. No. 419,850 filed Oct. 11, 1989 and such alloys may be used without applying an electrocatalytic coating.

The grid electrode may be formed in a variety of ways. For example, a coil of a sheet of a valve metal of appropriate thickness is passed through an expanding apparatus and the expanded titanium is then cut into strips of the desired width. The strips are then spaced in a jig in the form of the desired grid and the strips are welded together to form the grid. The resulting valve metal surfaces can then be coated with an electrocatalytic surface by known methods. In a variation of the process, the electrocatalytic coating may be applied to the surface of the expanded valve metal mesh as it exits from the expanding apparatus and it is then cut into strips which are then used to form the grid electrode.

Such electrocatalytic coating have typically been developed for use as anodic coatings in the industrial electrochemical industry and suitable coatings of this type have been generally described in U.S. Pat. Nos. 3,265,526; 3,632,498; 3,711,385 and 4,528,084, for example. The mixed metal oxide coatings usually include at least one oxide of a valve metal with an oxide of a platinum group metal including platinum, palladium, rhodium, iridium and ruthenium or mixtures of themselves and with other metals. It is preferred for economy that low load electrocatalytic coatings be used such as have been described in the U.S. Pat. No. 4,528,084, for example.

Among the preferred coatings are the dimensionally stable anodes wherein the coating consists of a valve metal oxide and a platinum group metal oxide and most preferably, a mixture of titanium oxide and ruthenium oxide. Another preferred coating is a cobalt spinel coating. In some installations, there can be provided a platinum and titanium metal interlayer between the substrate and the outer layer basis.

The valve metal strips are first cleaned by suitable means such as solvent-degreasing and/or pickling and etching and/or sandblasting, all of which are well known techniques. The coating is then applied in the form of solutions of appropriate salts of the desired metals and drying thereof. A plurality of costs is generally applied but not necessarily and the strips are then dried to form the metal and/or metal oxide electrocatalytic coating.

Typical curing conditions for the electrocatalytic coating can include cure temperatures of from about 300° C. up to about 600° C. Curing times may vary from only a few minutes for each coating layer up to an hour or more, e.g., a longer cure time after several coating layers have been applied. The curing operation can be any of those that may be used for curing a coating on a metal substrate. Thus, oven curing, including conveyor ovens may be utilized. Moreover, infrared cure techniques can be useful. Preferably, for most economical curing, oven curing is used and the cure temperature used will be within the range of from about 450° C. to about 550° C. At such temperatures, curing times of only a few minutes, e.g., from about 3 to 10 minutes, will most always be used for each applied coating layer.

The novel method of the invention for cathodically protecting steel reinforced concrete structures comprises impressing a constant anodic current upon grid electrodes of a plurality of valve metal strips with voids with an electrocatalytic surface and 2,000 to 7,000 nodes per square meter embedded in a steel reinforced concrete structure containing 0.5 to 5 square meters of steel surface to each square meter of concrete surface with the ratio of electrode surface to the steel surface being selected in maintain a uniform cathodic protection current density throughout the concrete structure. The uniform cathodic protection current density throughout the structure is achieved by varying the electrode surface to conform to the density of the steel rebar density which will vary throughout the structure, i.e. more steel rebars where a roadway is supported by pillars.

The electrode surface may be varied by the dimensions of the valve metal strips and/or varying the degree of voids of expansion of the valve metal strips and/or varying the spacing of the valve metal strips. This variation of the electrode surface with the density of the steel rebars ensures a constant uniform current distribution to obtain maximum anode life and effective cathodic protection of the steel rebars.

This ability to vary the electrode surface to match the rebar density prevents problems occuring in known cathodic protection systems such as that in U.S. Pat. No. 4,708,888. In that said patent, the electrode system can not be varied and therefore in areas where the rebar density is high, the cathodic protection current density is low resulting in insufficient protection of the steel surface and hence, steel corrosion. On the contrary, if one increases the anode current output to protect the higher rebar density areas, the anodic current density will be higher, resulting in shortened anode life and high electrolyte resistance due to the drying of the concrete (i.e. no electrolyte) near the anode. When the steel density is too low, the steel rebar current density is high resulting in excessive alkalinity at the steel rebar surface and steel embrittlement.

The invention has the advantage of allowing one to fine tune the current discharge to the reinforced concrete structure to protect the same from corrosion. Varying the dimension of the grid, varying the dimension of the strips and varying the degree of the expansion of both the strips and the anodic structure provide the possibility of varying the current discharge in a non-homogeneous manner to fit the need of the reinforced concrete structure. For example, because of the varying density of the reinforced steel rebars, the current discharge may vary from point to point of the concrete structure to avoid over or under protection.

This latter feature can be easily obtained by Applicants' system by welding the expanded valve metal strips at varying distances from each other or welding the expanded strips of different shapes and/or different degrees of expansion and the anodic structure can be fabricated in grid panels of varying dimensions to fit the needs of each individual structure. The successive welding of conductive bars to mesh can be obtained by simply substituting one expanded valve metal strip with a plain one in the grid. The dimensions of the strips and space between them can be optimized for a given current output, thus obtaining the minimum weight of valve metal substrate used per square meter of concrete.

The dimensions of the strips with void may vary from a width of 3 mm to 30 mm with a thickness of 0.25 mm to 2.5 mm and a length from one meter to 10 meters but these are merely preferred welded at 90° angles to each other but other angles are possible. The sides of the grid can either be quadrangular, rectangular or rhomboidal.

The current density delivered by the anodic structure to the reinforced concrete structure can vary depending upon the geometry of the grid panel, the degree of expansion of the strips and the dimensions of the strips. However, the preferred current density is between 2.5 to 50 mA per square meter of concrete. Again, this can be varied as well.

The structure of the anode of the invention, wherein the main openings of the grid are delimited by expanded metal strips instead of wires or strands of the prior art, allows for obtaining a further feature.

In fact, the concrete/anode contact area is distributed along the length and width of the strips preventing any harmful current flow concentration. By keeping the electric current in a "diluted" form in the concrete even in close proximity to the anode surface, the following advantages are obtained, which favorably affect practical operation:

lower ohmic drops, which allow for a higher current output with the same applied voltage lower rate of oxygen production at the anode/concrete interface, which fact, together with the open mesh structure of the strips, prevents formation of gas pockets, capable of interrupting the electric continuity of the circuit lower wear rate of the coating, especially important when long life anodes are required, still having a low-cost, low noble metal loading coating.

In the prior art anodes, the anode/concrete contact area is represented by the tiny surface of each wire of strand delimiting each main opening: as a consequence, the electric current concentrates close to the anode/concrete interface with all the troubles connected to higher ohmic drops and lower current output, formation of oxygen pockets, high wear-rate of the coating, which can be easily imagined by any expert in the field.

REFERRING NOW TO THE DRAWINGS

Figure 1:
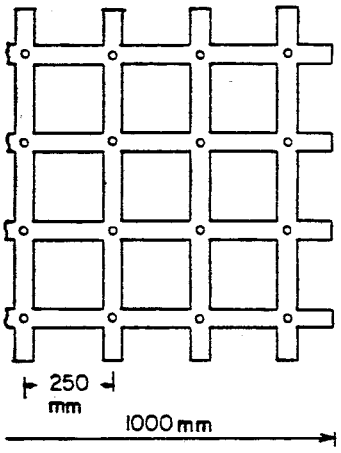
FIG. 1 is an example of one possible embodiment of a grid electrode of the invention and FIG. 2 is an expanded view of a partial section of the embodiment of FIG. 1.
Figure 2:
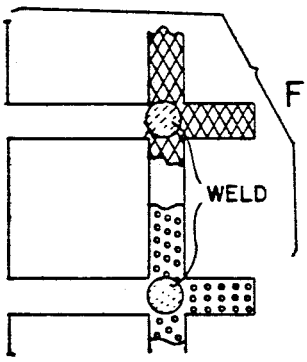

FIGS. 1 and 2 illustrate a preferred grid electrode of the invention using valve metal strips with voids 8 mm wide and 0.5 mm thick welded together to form a grid with a length of 250 mm. Such an anodic structure has an anodic contact surface of about 0.15 square meter per square meter of concrete and discharges about 15 mA per square meter of concrete. FIG. 2 shows the grid electrode with expanded metal strips and illustrates the welding points to hold the strips together.

Figure 3:
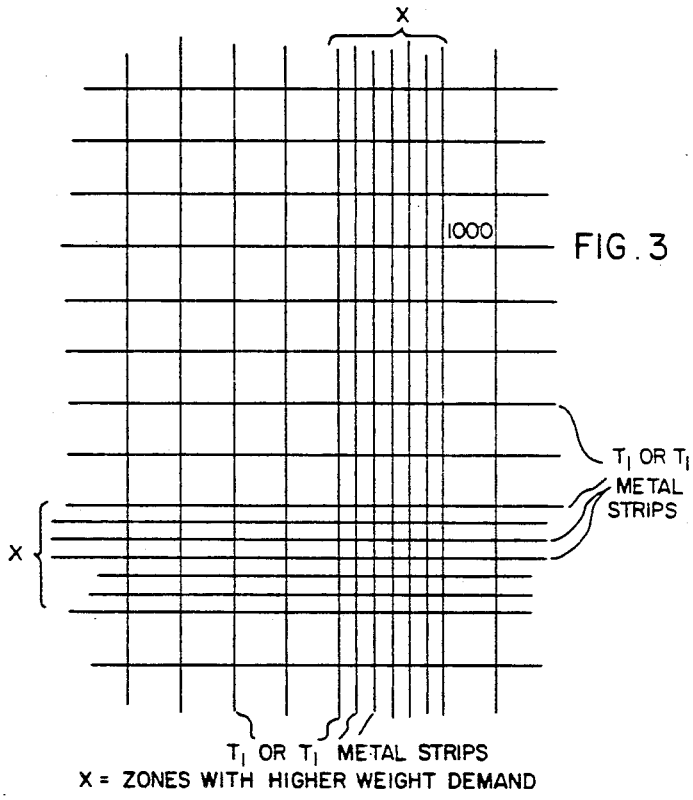
FIG. 3 is a plan view of a grid electrode of varying electrode surfaces to compensate for difference in density of the steel rebars in the concrete structure.

FIG. 3 illustrates the layout of the anode strips with voids to compensate for differences in the density of the concrete rebars so that there are zones of varying cathodic protection current density which conforms to the rebar density. The system of FIG. 3 can be used to fine tune the current discharge across the surface of the reinforced concrete structure to be protected to provide a very advantageous cathodic protection system. It is known that in all reinforced concrete structures, the density of the reinforcing bar varies with the location, in addition in prestressed reinforced concrete structures, it is possible to avoid the problem of overprotection caused by the prior art systems in zones with low rebar density. Overprotection results in hydrogen embrittlement of the concrete rebars thereby weakening the structure.

The grid electrode of the invention may be fabricated in panels of variable dimensions as noted above having a width from 1 to 3 meters and a length of 2 to 6 meters which are particularly useful for cathodic protection of vertical concrete structures. For a horizontal concrete structure such as a bridge deck or a garage deck, the grid electrode can be fabricated in rolls of 0.5 to 3 meters width with a length of 10 to 100 meters.

Various modifications of the grid electrodes of the invention can be made without departing from the spirit or scope of the invention and it is to be understood that the invention is intended to be limited only in accordance with the appended claims.

What is claimed is:

1. A grid electrode for cathodic protection of steel reinforced concrete structures comprising a plurality of valve metal strips each with an electrocatalytic surface, each of said strips having voids and nodes, said nodes being 2,000 to 7,000 nodes per square meter, said strips being connected together to form the grid.

2. A grid electrode of claim 1 wherein the valve metal strips with voids are strips of expanded valve metal mesh.

3. A grid electrode of claim 1 wherein the electrode surface across the grid is varied by at least one means of the group consisting of strips of varying dimensions, strips of varying voids and strips of different spacing to vary the current density over the electrode surface.

4. The electrode of claim 1 wherein there is a current distribution member connected thereto.

5. The electrode of claim 1 wherein the electrocatalytic surface is a cobalt spinel coating.

6. The electrode of claim 1 wherein the electrocatalytic surface is a coating containing a platinum group metal oxide.

7. The electrode of claim 1 wherein the electrocatalytic surface is a mixed metal oxide coating.

8. The electrode of claim 7 wherein the mixed metal oxide includes at least one oxide of a valve metal selected from a group consisting of titanium and tantalum and the second oxide of a platinum group metal oxide selected from the group consisting of platinum oxide, palladium oxide, rhodium oxide, irridium oxide and ruthenium oxide and mixtures thereof.

9. A cathodically protected steel reinforced concrete structure with a grid electrode of claim 1 mounted on the concrete structure with an ion conductive overlay.

10. The structure of claim 9 wherein the grid electrode for the cathodic protection of steel reinforced concrete structure comprises an expanded valve metal grid electrode with 2,000 to 7,000 nodes per square meter with an electrocatalytic coating.

11. The structure of claim 9 wherein there is a current distribution member connected to the electrode grid.

12. The structure of claim 9 wherein the electrocatalytic surface is a cobalt spinel coating.

13. The structure of claim 9 wherein the electrocatalytic surface contains a platinum group metal oxide.

14. The structure of claim 9 wherein the electrocatalytic surface is a mixed metal oxide coating.

15. The structure of claim 9 wherein uniform cathodic protection current density is maintained throughout the concrete structure by at least one means of the group consisting of using metal strips of different dimension, strips of varying voids and different spacing of strips.

16. A method of cathodically protecting steel rebar reinforced concrete structures comprises impressing a constant anodic current upon grid electrodes of a plurality of valve metal strips, each with an electroctalytic surface, each of said strips having voids and nodes, said nodes being 2,000 to 7,000 nodes per square meter, said strips being connected together to form the grid electrodes, said grid electrodes being embedded in a steel reinforced concrete structure containing 0.5 to 5 square meters of steel surface for each square meter of concrete surface with the ratio of grid electrode surface to the steel surface being selected to maintain a uniform cathodic protection current density throughout the concrete structure.

17. The method of claim 16 wherein the current density is 2.5 to 50 milliamperes per square meter of concrete surface.

18. The method of claim 16 wherein the uniform cathodic current density is achieved by varying the electrode surface by at least one means of the group consisting of using strips of different dimensions, strips of varying voids and different spacing of strips to conform to the current density of the steel rebar surface.

19. The method of claim 16 wherein the grid electrodes are connected to a current distribution member.

20. The method of claim 16 wherein the electrocatalytic surface is a cobalt spinel coating.

* * * * *

UNITED STATES PATENT AND TRADEMARK OFFICE

CERTIFICATE OF CORRECTION

PATENT NO. : 5,062,934

DATED : November 5, 1991

INVENTOR(S) : GIAN L. MUSSINELLI

It is certified that error appears in the above-identified patent and that said Letters Patent is hereby corrected as shown below:

On Title Page, item [19] and [75]

The correct spelling of the inventor's name is

GIAN L. MUSSINELLI

Signed and Sealed this

Ninth Day of March, 1993

*Attest:*

*Attesting Officer*

STEPHEN G. KUNIN

*Acting Commissioner of Patents and Trademarks*